US006295748B1

(12) United States Patent
Menke et al.

(10) Patent No.: US 6,295,748 B1
(45) Date of Patent: Oct. 2, 2001

(54) APPARATUS FOR TURNING OVER INDIVIDUAL SHEETS ASSEMBLED TO FORM A STACK

(75) Inventors: Wilhelm Menke; Börge Heidersberger, both of Bingen am Rhein (DE)

(73) Assignee: NSM Aktiengesellschaft, Bingen am Rhein (DE)

( * ) Notice: Subject to any disclaimer, the term of this patent is extended or adjusted under 35 U.S.C. 154(b) by 0 days.

(21) Appl. No.: 09/375,573

(22) Filed: Aug. 16, 1999

(30) Foreign Application Priority Data

Aug. 17, 1998 (DE) ..... 198 37 235

(51) Int. Cl.[7] ..... B42F 17/20; G09F 11/30

(52) U.S. Cl. ..... 40/389; 40/509; 40/511; 84/487; 84/520

(58) Field of Search ..... 40/476, 492, 508, 40/509, 511, 510, 531, 389; 84/487, 517, 520

(56) References Cited

U.S. PATENT DOCUMENTS 1,972,416 * 9/1934 Bascom ..... 40/531
3,268,868 * 8/1966 Rockola ..... 40/389 X
3,412,496 * 11/1968 Hendricks et al. ..... 40/389
4,831,758 * 5/1989 Williams et al. ..... 40/389 X
5,032,346 * 7/1991 Herring et al. ..... 40/475 X
5,077,923 * 1/1992 Rockola et al. ..... 40/475 X
5,704,146 * 1/1998 Herring et al. ..... 40/509

FOREIGN PATENT DOCUMENTS

441949 * 3/1991 (EP) .

* cited by examiner

*Primary Examiner*—Brian K. Green
(74) *Attorney, Agent, or Firm*—Dilworth & Barrese, LLP.

(57) ABSTRACT

In an apparatus for turning over individual sheets assembled to form a stack, preferably for leafing through program tiles of a jukebox, the sheets are arranged to pivot about mutually parallel pivot pins and are provided with projections rising above the pivot pins on which a support engages so that a sheet is turned over to the opposite side. A space-saving design, in which unintentional turning-over of the pages is effectively prevented, is provided in that at least one fixing device and stop device are provided, the fixing device being in contact with the open sheets so that in the turning-over movement of an open sheet it is moved against a force acting on the fixing apparatus, and the stop device being arranged so that the sheets adjoining the open sheets are in contact with the stop device so that their pivoting in the turning-over direction is prevented at least until the projections of the adjacent sheets are in a position of engagement with the support.

16 Claims, 3 Drawing Sheets

APPARATUS FOR TURNING OVER INDIVIDUAL SHEETS ASSEMBLED TO FORM A STACK

FIELD OF THE INVENTION

The present invention relates to an apparatus for turning over individual sheets assembled to form a stack, preferably for leafing through program pages of a jukebox, the sheets being arranged to pivot about mutually parallel pivot pins and being provided with projections rising above the pivot pins on which a support engages so that a sheet is turned over to the opposite side.

PRIOR ART

Such an apparatus for the turning-over of sheets is known, for example, from EP 0 441 949 B1. In this case, the individual sheets are arranged in two stacks side by side in a housing and are mounted pivotably at their rear sides. The leafing-through of the individual sheets is achieved in that a strip is provided which can be reciprocally moved by a drive and is provided with stops which engage on projections of the program sheets extending above the pivot pins and, accordingly, effect the turning-over of the sheets.

In previously known apparatuses for leafing through sheets, and especially for leafing through program pages of a jukebox, the pivot pins of the sheets and hence the individual stacks of program pages are arranged inclined, which entails the advantage that the respective contents are easier to read and also means that the currently open sheets lie reliably on the respective stacks as a result of gravity and cannot be inadvertently turned over. Such an oblique arrangement, however, entails the disadvantage that the jukeboxes in question take up a relatively large amount of space. If a space-saving design is to be provided here, it is necessary to position the sheets vertically, which is advantageous especially in the case of wall-mounted jukeboxes. However, this arrangement entails the disadvantage that the abovementioned action of gravity in reliably securing of the sheets on the stacks no longer obtains and incorrect random leafing-through of sheets cannot reliably be prevented.

OBJECT OF THE INVENTION

The object of the present invention is to develop an apparatus of the above type in order to achieve a space-saving design while preventing the unintentional turning-over of sheets.

SUMMARY OF THE INVENTION

Accordingly, this object is achieved, with apparatus for turning over individual sheets assembled to form a stack, the sheets being arranged to pivot about mutually-parallel pivot pins and being provided with projections rising above the pivot pins on which a support engages so that a sheet is turned over to the opposite side, wherein at least one fixing device and stop means are provided, the fixing device being in contact with the open sheets so that in the turning-over movement an open sheet is moved against a force acting on the fixing device, and wherein the stop means are arranged so that the next sheets adjoining the open sheets are in contact with the stop means so that their pivoting in the turning-over direction is prevented at least until the projections of said adjacent sheets are in a position of engagement with the support.

The effect of this is that, even with a vertical design of the program pages or a vertical arrangement of the pivot pins, a random or unintentional turning of the open pages and of the sheets adjoining the open sheets is prevented. The effect of the fixing devices is that the open pages can only be turned over against an output of force, as a result of which incorrect random leafing-through is prevented. When an open page is turned over in the desired manner, the effect of the stop means according to the invention is that the adjoining sheets, in whole or in part, are not also turned over but are prevented from turning over at least until they are in a position of engagement with the support such that their pivoting in the direction of turning-over is prevented. Thus the desired pages are completely opened up and incorrect turning of the following pages when leafing through is prevented.

In a preferred embodiment of the present invention, the sheets may be pivotably arranged in the marginal region of one side on a section which can be displaced in both directions in guides of a housing by a drive. Such an arrangement results in the advantage that the supports are arranged to be stationary or are fixed to the housing and can be oriented as desired, preferably centrally, relative to the viewing window. The open pages of the program sheets always appear at the same point in the viewing window in this case.

In a further embodiment of the present invention, the fixing device may have a spring-loaded pin and a roller arranged thereon, the pin being received in a guide extending perpendicularly to the direction of movement of the displaceable section and arranged in the housing, and the roller being in contact with the sides of the open sheets possessing the projections. The roller can be rotatably mounted on the pin. The contact of the pin with the open sheets and the movement of the pin only against an increased expenditure of force means that the open sheets reliably remain in their position. The force acting on the roller is generated by the spring-loaded pin on which the roller is arranged. If a sheet is unintentionally turned over, the side of the open sheet having the projections moves on its contour about the roller, whereby the roller and the spring-loaded pin are moved in a direction perpendicular to the direction of movement of the section. If the displaceable section is moved on, the support engages into the projection of the sheet adjoining the sheet to be turned over. When the leafing operation is complete, the roller now rests on the newly open sheets and, accordingly, prevents their unintentional turning-over.

Preferably the support consists of a rod parallel to the pivot pins and each projection has flanks lying approximately at right angles to one another, the rod running over the flank lying in the direction of movement until it impacts upon the flank at right angles thereto and pivots this, turning the sheets over in the direction of movement.

It is particularly advantageous if the spring-loaded pin forms the rod, in other words the two functions are taken over by one and the same component. In this case, the pin or rod in question first causes the pivoting-over of the sheets to be leafed through and acts as a support for this purpose. Secondly, the pin in question bears the roller and effects the fixing of the open sheets in the desired position.

It is particularly advantageous if the rod and the stop means lie in the vertical median plane of the viewing window of the housing and are arranged against a back wall of the housing. The effect of this is that the median line between two open pages always lies at the center of the viewing window.

The stop means may be designed as plates arranged on the housing which have a thickness decreasing in the direction of the support so that the open sheets are freely pivotable relative to the plates. The effect of this is that the open sheets, which are held in their position by the fixing device are not obstructed by the plates in their pivot movement.

The plates may be arranged symmetrically to the support.

In a further embodiment of the present invention, the displaceable section may be provided with journals arranged in a row on which the sheets are pivotably mounted.

It is particularly advantageous if two mutually parallel displaceable sections are provided, with which the sheets are pivotably connected on both sides in the marginal region of one side, which are displaceable in synchronism. This makes it possible for the sheets to be fixed in a particularly stable manner to pivot on the mutually parallel sections.

In order to ensure the movability of the sections, at least one of the displaceable sections may be connected to a toothed rod which engages with a pinion which can be driven by a motor. In order to achieve the synchronized movement of the other section, a shaft may, for example, be provided, with two pinions each of which engages with a corresponding toothed rod of the sections.

According to a preferred embodiment of the present invention a gearwheel of the gearing, driving the pinion via a controllable electric motor, is provided with a mask which can be scanned by a light barrier and effects a progressive leafing-through of the sheets. In this arrangement, the light barrier emits signals to a control unit as a function of the marks scanned, the control unit then controlling the electric motor so that the program sheets are leafed through stepwise or continuously in successive steps.

It is particularly advantageous if the two parallel sections form the top and bottom of a frame and are connected by means of two connecting members arranged perpendicularly to the sections. In this manner, a transport frame is formed whose top and bottom are formed by the parallel displaceable sections and which supports the program sheets arranged to pivot on the sections. In this arrangement, the sections are received in corresponding guides of the housing. At least one of the sections has a toothed rod which is moved by a pinion driven by a motor. The synchronicity of the movement of the two sections is achieved by the connecting members arranged vertically thereto, as a result of which the provision of a shaft provided with two pinions becomes superfluous.

In order to ensure a particularly strong construction, the connecting members may be connected to one another by braces.

In a further embodiment of the present invention, provision is made for the sheets to possess horizontally adjacent compartments on both sides for fixing the title pages of the content leaflets and the lists of titles of available CD disks.

BRIEF DESCRIPTION OF THE DRAWINGS

Further details and advantages of the present invention are explained in detail with reference to an example of embodiment shown in the drawing, in which.

DETAILED DESCRIPTION OF THE PREFERRED EMBODIMENT

Figure 1:
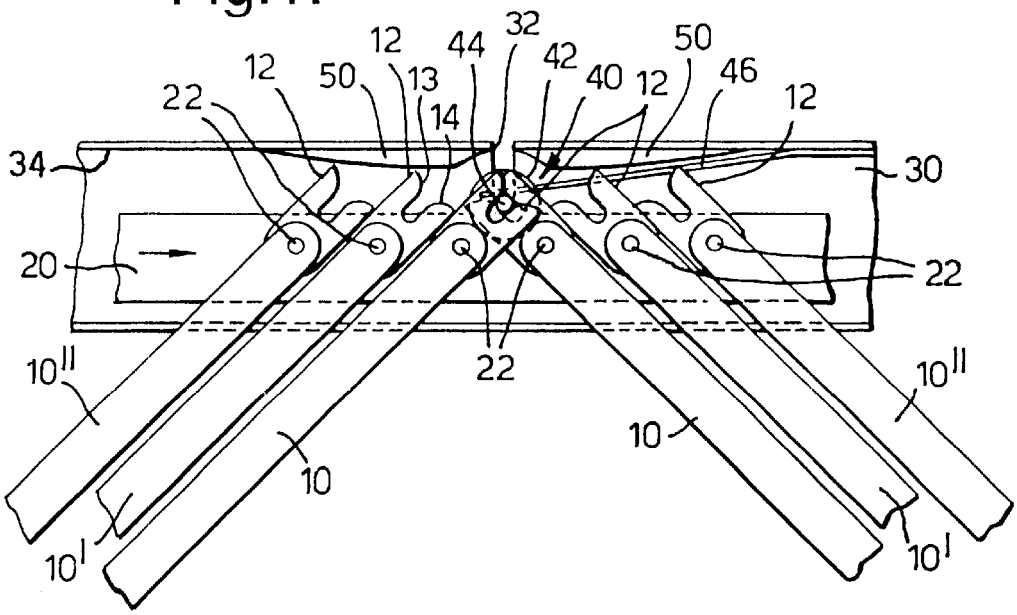
FIG. 1 shows a diagrammatic plan view of the program sheets arranged to pivot on a sectional strip in a read-off position.

FIG. 1 shows, in a diagrammatic plan view, the apparatus according to the invention with the program sheets 10, 10', 10". The sheets 10, 10', 10" are arranged about mutually parallel pivot pins 22 on the section 20 which, according to FIG. 1, can be moved to left and right.

The section 20 is movably received in a guide of the housing 30.

Arranged on the side of the sheets 10, 10', 10" facing the back wall 34 of the housing are the projections 12, which have a forked shape. The projections 12 rise above the pivot pins 22. They have flanks 13, 14 approximately at right angles to one another which serve to pivot the sheets 10, 10', 10" when the section 20 is moved.

On the back wall 34 of the housing are the plates 50, which according to the invention serve as stop means and on which the projections 12 of the sheets 10' adjoining the open sheets 10 rest. The effect of the plates 50 is that a pivoting of the sheets 10' in the direction of turning-over is impossible, because the projections 12 of the sheets 10' cannot move past the plates 50 when pivoted in the direction of turning-over.

Arranged between the plates 50 is the fixing device 40, which according to the present example of embodiment comprises the roller 42, the spring-loaded pin 44 and the spring 46. The pin 44 is received in the guide 32 of the housing 30 to be movable in a direction lying perpendicular to the direction of movement of the section 20.

The pin 44 is arranged at the center of the viewing window of the housing, which guarantees that the median line between two open sheets 10 also always lies at the center of the viewing window.

The effect of the spring 46 is that, in the read-off position, the spring-loaded pin 44 and the roller 42 arranged thereon are held in their position shown in FIG. 1. In this position, the roller 42 is in contact with the open sheets 10 so that the roller 42 is moved, during the pivoting of one of the open sheets 10, out of the position shown against the force of the spring 46. Because the spring force has to be overcome in order to turn over the sheets 10, unintentional leafing-over of the open sheets 10 is prevented, as a result of which the latter remain in the desired position in which the appropriate contents can be read off.

Figure 2:
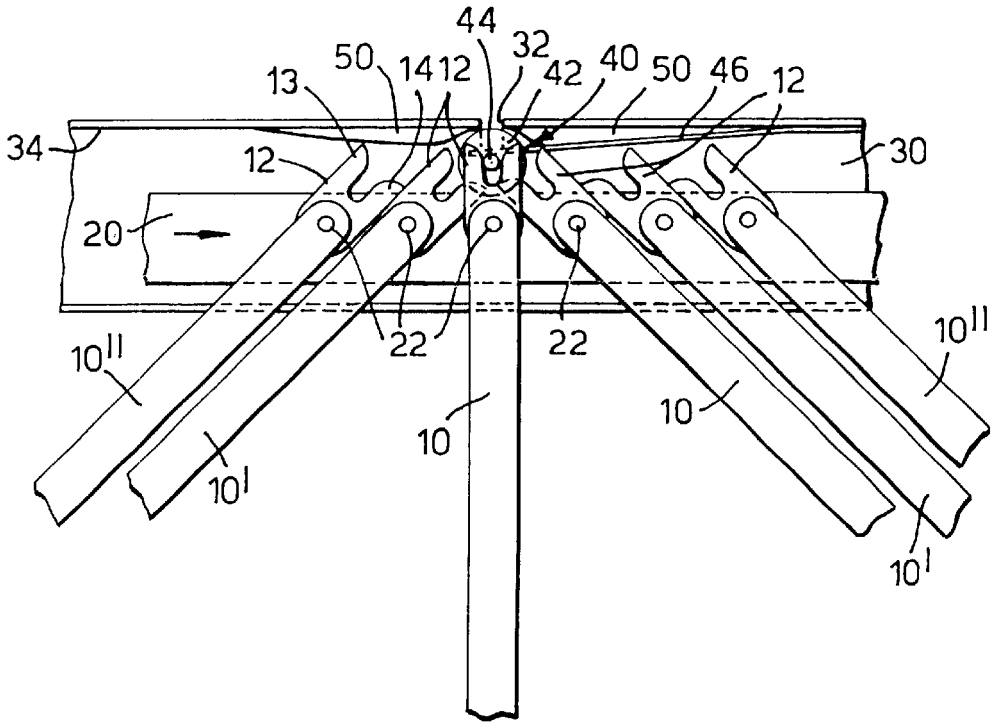
FIG. 2 shows a view according to FIG. 1, in which one of the program sheets is being pivoted.

If the program sheet 10 shown on the left in FIG. 1 is to be leafed over, the section 20 is moved to the right. The rod 44 serving as a support causes, because of its contact with the projection 12 of the sheet 10 shown on the left in FIG. 1, a pivoting of that sheet into the position shown in FIG. 2. When this occurs, the roller 42 is guided along the outer contour of the side of the sheet 10 having the projection 12 and, as shown in FIG. 2, displaced upwards, in other words towards the rear wall 34 of the housing, by the contact with this contour. Accordingly, the rod 44 is also moved upwards by a corresponding amount in the guide 31 of the housing and the spring 46 is tensioned.

The movement of the section 20 has the additional consequence that the projection 12 of the right-hand sheet of the open sheets 10 is released from the rod 44.

The left-hand sheet 10' remains in contact with the left-hand plate of the plates 50, according to the invention, at least until the projection 12 of the sheet 10' arranged so that free pivoting of the sheet 10' is prevented by the rod 44. The effect of this is that the left-hand sheet 10' is not turned over, while the sheet 10 is pivoted.

Figure 3:
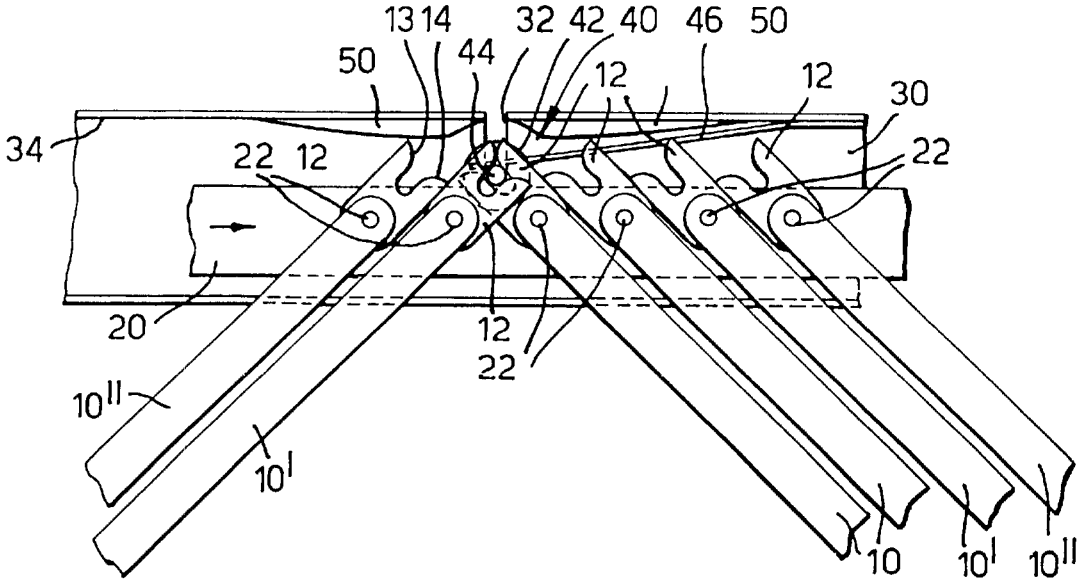
FIG. 3 shows a view according to FIG. 1 after completion of the leafing-through operation.

When the section 20 is moved further to the right, the left-hand sheet 10' is now released by the plate 50 and, after completion of the leafing operation, as shown in FIG. 3, is in contact with the roller 42 by its side having the projections 12. The pivoted sheet 10 lies, symmetrically thereto, on the stack of sheets shown on the right. In this position, the open sheets 10, 10' are held in their position by the fixing device 40.

The effect of the pivoting of the sheet 10 out of the position shown in FIG. 2 into that shown in FIG. 3 is that the roller 42 and the rod 44 in the guide 31 are moved away downwards according to FIG. 3, in other words away from the rear wall 34 of the housing, by the force of the spring 46, and the sheets 10, 10' are now fixed in the open position as shown in FIG. 3.

The plates 50 are arranged symmetrically relative to the rod 44 and have a thickness that decreases in the direction of the support. The result of this is that the sheets in contact with the rod 44 are freely pivotable.

Figure 4:
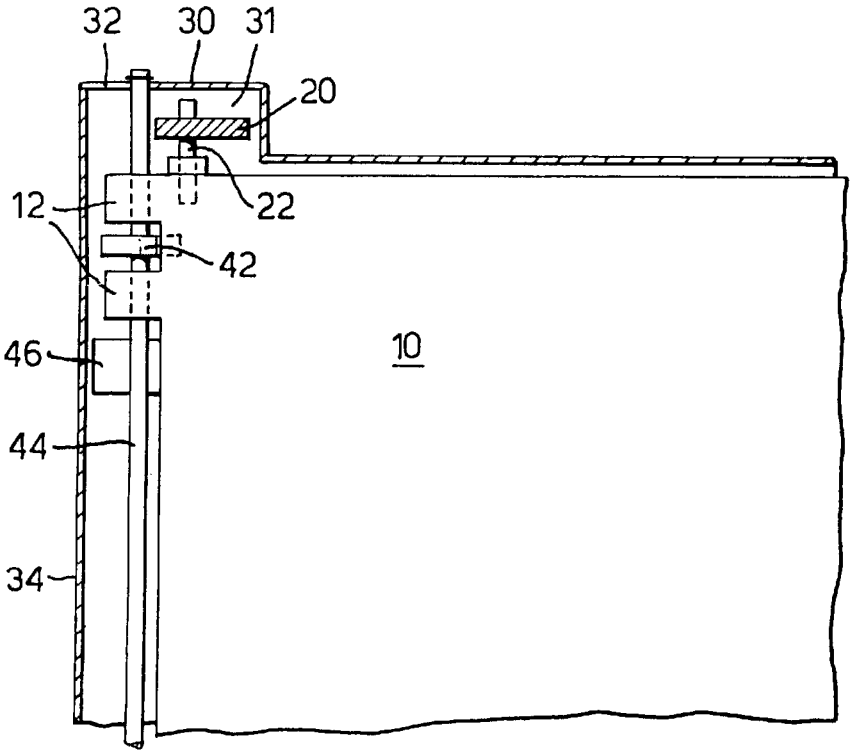
FIG. 4 shows a diagrammatic view in longitudinal section of the apparatus according to the invention.

FIG. 4 shows, in longitudinal section, the arrangement of the rod or spring-loaded pin 44 which is movably received in a guide 32 of the housing 30. FIG. 4 also makes it clear that the sheets 10 are pivotably connected to the journals 22 which are arranged in a row on the section 20. The section 20 is movably received in the guide 31 of the housing 30.

It is also apparent from FIG. 4 that, according to the present example of embodiment, the roller 42, which is rotatably arranged on the pin 44, is arranged between the projections 12 of the sheets 10. Below the projections 12 is the spring 46, which exerts upon the pin 44 a force acting towards the right according to FIG. 4.

Figure 5:
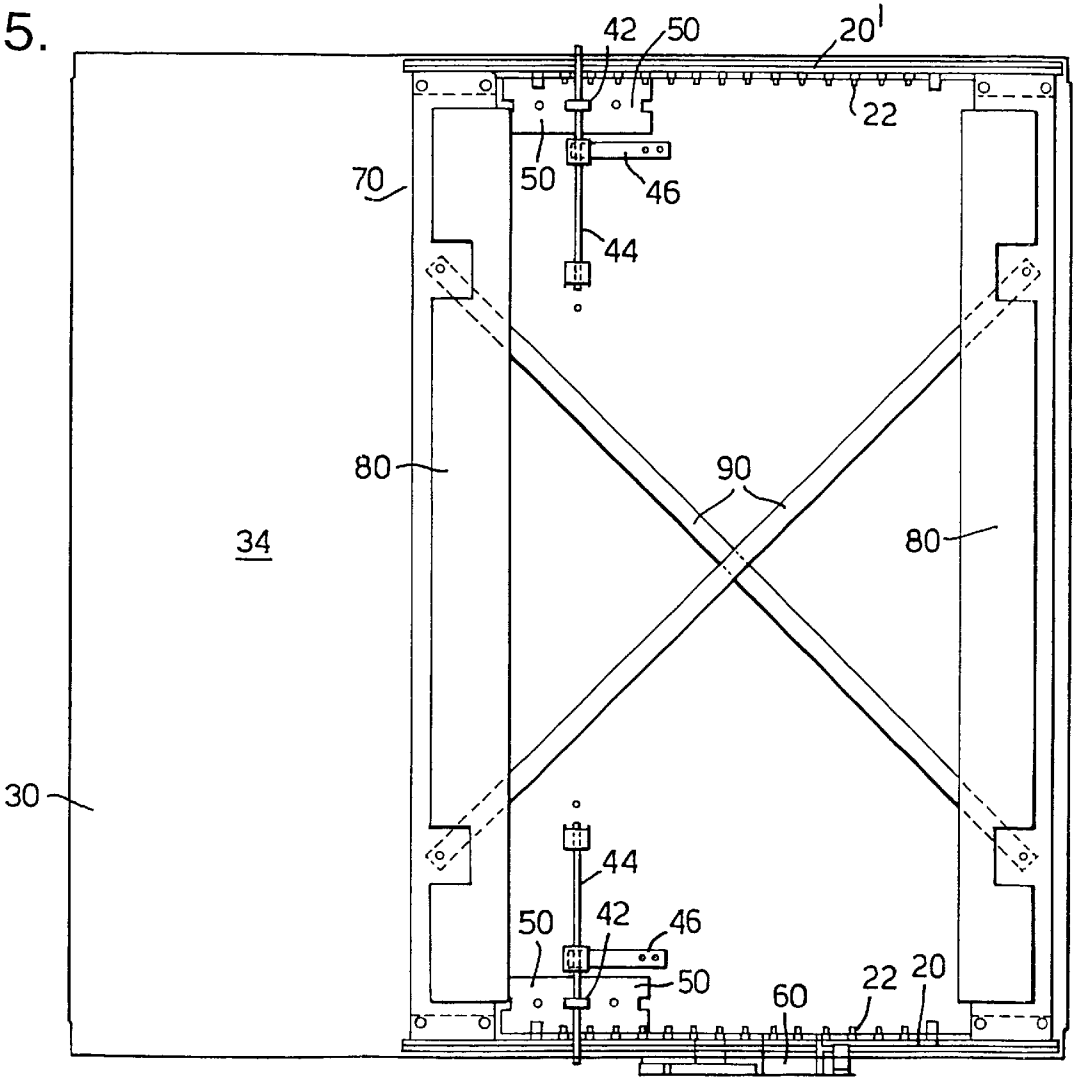
FIG. 5 shows a plan view of the apparatus according to the invention with a housing and a frame for mounting the program sheets.

It is apparent from FIG. 5 that, according to the present example of embodiment, two parallel sections 20, 20' are provided with which the sheets are on both sides pivotably connected in the marginal region and which are connected to one another by the vertically standing connecting members 80. The connecting members 80 are strengthened by means of the braces 90. The sections 20, 20' and the connecting members 80 form the frame 70 within which the sheets (not shown) are pivotably arranged. To this end, the sections 20, 20' have the journals 22 which define parallel pivot axes lying in one plane. The sections 20, 20' are movably arranged in guides 31 of the housing 30. Movement takes place by means of the controllable electric motor 60, which engages via a pinion with a toothed rod of the section 20 and thus effects movement of the entire frame 70.

The plates 50, arranged in pairs and symmetrically, the pins 44 and the spring 46 are arranged on the rear wall 34 of the housing 30 at the top and bottom in a symmetrical design at the center of a viewing window. The roller 42 is rotatably mounted on the pins 44.

Figure 6:
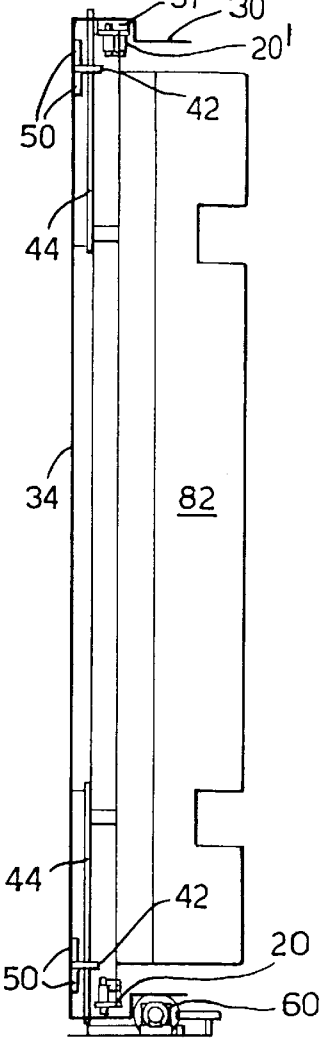
FIG. 6 shows a lateral view of the apparatus according to FIG. 5.

FIG. 6 also shows, in a lateral view, the end stops 82 which are arranged on the connecting parts 80.

What is claimed is:

1. A combination including individual sheets (10, 10', 10") assembled to form a stack and apparatus for turning over the sheets (10, 10', 10") from one side to another, the sheets (10, 10', 10") comprising mutually parallel pivot pins (22) and being arranged to pivot thereabout, and the sheets (10, 10', 10") each being provided with respective projections (12) rising above the respective pivot pins (22), a support (44) structured and arranged to engage the projections (12) such that a sheet (10) is turned over from one side to an opposite side thereof, wherein at least one fixing device (40), means (46) for providing a force against the at least one fixing device (40), and a stop device (50) are provided, the at least one fixing device (40) being in contact with open sheets (10) of the stack such that, in a turning-over movement, an open sheet (10) is moved against the force of said force means (46) acting upon the at least one fixing device (40), and the stop device (50) is arranged such that sheets (10') adjacent the open sheets (10) in the stack are in contact with the stop device (50) and pivoting of these adjacent sheets (10') in the turning-over movement is prevented, at least until the respective projections (12) of these adjacent sheets (10') are in a position of engagement with the support (44).

2. The combination according to claim 1, additionally comprising a housing (30) for said combination and comprising a guide (31) therein, a section (20) movably received in said guide (31) and arranged to move in back and forth direction, wherein said pivot pins (22) are each mounted upon said movable section (20) such that the sheets (10, 10', 10") of the stack are pivotally mounted thereon.

3. The combination according to claim 2, additionally comprising a drive (60) arranged to displace the movable section (20) in the back and forth direction.

4. The combination according to claim 2, wherein the fixing device (40) and force means (46) therefor include a spring-loaded (46) pin (44) and a roller (42) arranged on the pin (44), the pin (44) being received in a second guide (32) of the housing (30) to extend perpendicularly to the direction of movement of the movable section (20), and the roller (42) be in contact with sides of the open sheets (10) having the projections (12).

5. The combination according to claim 4, wherein the support (44) is constituted by a rod (44) arranged to be parallel to the pivot pins (22) of the sheets (10, 10", 10") forming the stack, each projections (12) of the sheets (10, 10", 10") comprising flanks (13, 14) lying approximately at right angles to one another, the rod (44) arranged to run over one of the flanks (13,14) lying in the direction of movement until the rod (44) impacts upon said one flank (13, 14) at right angles thereto and pivots this flank (13, 14), thereby turning over the respective sheet (10) in the direction of movement, and the spring-loaded pin (44) forms the rod (44).

6. The combination according to claim 2, wherein the movable section (20) is provided with journals (22) arranged in a row on the section (20) and on which the sheets (10, 10', 10") are pivotally mounted.

7. The combination according to claim 2, comprising two said mutually parallel displaceable sections (20,20') upon which the sheets (10, 10', 10") forming the stack are pivotally connected at opposite ends thereof, with said sections (20,20') being displaceable in synchronism.

8. The combination according to claim 7, additionally comprising a motor (60), a pinion arranged to be driven by the motor (60), and a toothed rod which engages the pinion and is connected to at least one of the displaceable sections (20,20').

9. The combination according to claim 7, additionally comprising a frame (70), wherein the two displaceable sections (20,20') form a top and bottom respectively of the frame (70) and additionally comprising two connecting members (80) arranged perpendicularly to the displaceable sections (20,20') and connecting the displaceable sections (20,20') to one another.

10. The combination according to claim 9, additionally including braces (90) which connect the connecting members (80) with one another.

11. The combination according to claim 1, wherein the support (44) is constituted by a rod (44) arranged to be parallel to the pivot pins (22) of the sheets (10, 10', 10") forming the stack, each projection (12) of the sheets (10,10', 10") having flanks (13,14) lying approximately at right angles to one another, and the rod (44) arranged to run over one of the flanks (13, 14) lying in the direction of movement until the rod (44) impacts upon said one flank (13, 14) at right angles thereto and pivots this flank (13, 14), thereby turning the respective sheet (10) over in the direction of movement.

12. The combination according to claim 1, additionally comprising a housing (30) for said combination, wherein said support is a rod (44) which, together with the stop device (50) lie in a vertical median plane of a viewing window of the housing (30) and are arranged against a back wall (34) of the housing (30).

13. The combination according to claim 1, additionally comprising a housing (30) for said combination, wherein the stop device (50) is structured and arranged as plates (50) which are arranged upon the housing (30) and structured to have a thickness decreasing in a direction of the support (44) such that open sheets (10) are freely pivotal relative to the plates (50).

14. The combination according to claim 13, wherein the plates (50) are arranged symmetrically with respect to the support (44).

15. The combination according to claim 1, wherein the sheets (10, 10', 10") forming the stack, each have horizontally adjacent compartments on both sides thereof for fixing title pages of contents and titles of available CD disks.

16. A jukebox including the combination according to claim 1, for leafing through program titles of said jukebox.

* * * * *